US007270558B1

(12) United States Patent
Chiang

(10) Patent No.: US 7,270,558 B1
(45) Date of Patent: Sep. 18, 2007

(54) ELECTRICAL CONNECTOR ASSEMBLY

(75) Inventor: Shu-Man Chiang, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/376,135

(22) Filed: Mar. 16, 2006

(51) Int. Cl.
*H01R 13/28* (2006.01)

(52) U.S. Cl. ..... 439/289; 439/700

(58) Field of Classification Search ..... 439/701, 439/709, 712, 715, 289, 700, 824, 362, 638
See application file for complete search history.

(56) References Cited

U.S. PATENT DOCUMENTS 4,963,102 A * 10/1990 Gettig et al. ..... 439/291
D373,568 S * 9/1996 Bloom et al. ..... D13/133
5,807,123 A * 9/1998 Spiegelaar et al. ..... 439/188
5,823,815 A * 10/1998 Takata ..... 439/374
5,967,856 A * 10/1999 Meller ..... 439/700
6,071,141 A * 6/2000 Semmeling et al. ..... 439/353
6,083,059 A * 7/2000 Kuan ..... 439/862
6,783,405 B1 * 8/2004 Yen ..... 439/824

* cited by examiner

*Primary Examiner*—Tho D. Ta
*Assistant Examiner*—Vanessa Girardi
(74) *Attorney, Agent, or Firm*—Birch, Stewart, Kolasch & Birch, LLP

(57) ABSTRACT

An electrical connector assembly includes a first insulating body and a second insulating body connected with the first insulating body. A plurality of first contacts are disposed in the first insulating body, and a plurality of second contacts are disposed in the second insulating body. The rear-touching portion of the first contacts and the rear-touching portion of the second contacts touch each other. The front-touching portion of the first contacts and the front-touching portion of the second contacts mate with other connectors. There are a plurality of fixing blocks provided on the rear portion of the first insulating body and corresponding fixing holes defined in the rear portion of the second insulating body, so the electrical connector assembly according to the present invention has a simplified structure and is convenient for assembling.

7 Claims, 6 Drawing Sheets

ELECTRICAL CONNECTOR ASSEMBLY

BACKGROUND OF THE INVENTION

1. Field of the Invention

The present invention relates to an electrical connector assembly, and more particularly, to an electrical connector assembly having simplified structure and being convenient for assembling.

2. The Related Art

It is known that electrical connector assemblies are indispensable units installed in electrical products for transmitting signals and power. For present, more and more electrical connector assemblies are designed to adapt to the variety, the multiple functions and the high transmission properties of the electrical products.

There is an electrical connector assembly, which has two mating faces for respectively mating with matching connectors. This electrical connector assembly commonly includes a first insulating body, a second insulating body and an assembling cover. The first insulating body receives a plurality of first contacts therein. The second insulating body receives a plurality of second contacts therein. The rear-touching portions of the first contacts and the rear-touching portions of the second contacts are respectively connected with a PCB. The assembling cover assembles with the first insulating body and the second insulating body together. As using, the front-touching portions of the first contacts and the front-touching portions of the second contacts respectively mate with the matching connectors.

However, the electrical connector assembly provides a separate assembling cover for assembling the first insulating body and the second insulating body, which results in complicated structure and inconvenience for assembling.

SUMMARY OF THE INVENTION

Accordingly, an object of the present invention is to provide an electrical connector assembly having simplified structure and being convenient for assembling.

The electrical connector assembly includes a first insulating body having a front portion and an opposite rear portion, a plurality of fixing blocks being provided on the top and bottom surfaces of the rear portion, a plurality of first contact grooves crossing through the first insulating body; a plurality of first contacts each of which has a positioning-portion, a front-touching portion, a rear-touching portion, the positioning-portion held in the first contact groove, the front-touching portion located out of the front portion of the first insulating body, the rear-touching portion located out of the rear-portion of the first insulating body; a second insulating body having a front portion and an opposite rear portion, a plurality of fixing holes being defined in the rear-portion of the second insulating body, the fixing blocks of the first insulating body locked in the fixing holes of the second insulating body, a receiving cavity crossing through the second insulating body, the rear-touching portions of the first contacts being received in the receiving cavity; and a plurality of second contacts disposed in the receiving cavity, each second contact having a positioning-portion, a front-touching portion and a rear-touching portion, the front-touching portion of the second contact located at the front portion of the second insulating body, the rear-touching portion of the second contact located at the rear portion of the second insulating body, the rear-touching portion of the second contact touching with the rear-touching portion of the first contact in the receiving cavity.

In the present invention, there are a plurality of fixing blocks provided on the rear portion of the first insulating body and corresponding fixing holes defined in the rear portion of the second insulating body, so that the electrical connector assembly according to the present invention has a simplified structure and is convenient for assembling.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
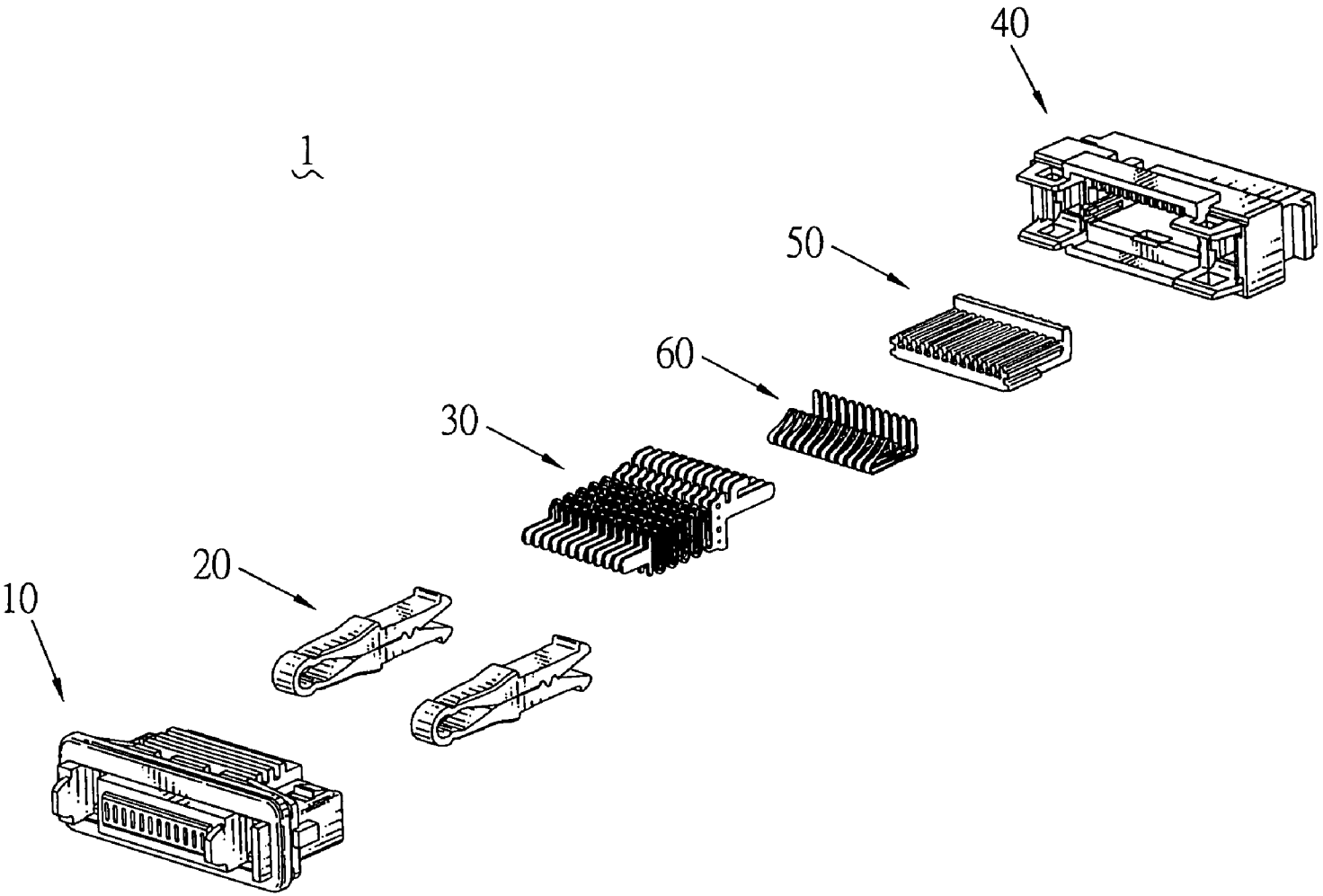
FIG. 1 is an exploded view of an electrical connector assembly according to present invention.

Please refer to FIG. 1. An electrical connector assembly 1 according to the present invention is illustrated. The electrical connector assembly 1 includes a first insulating body 10, a pair of latching arms 20 latched at the two sides of the first insulating body 10, a plurality of first contacts 30 disposed in the first insulating body 10, a second insulating body 40 connected with the first insulating body 10, a contact base 50 received in the second insulating body 40 and a plurality of second contacts 60 disposed in the second insulating body 40.

Figure 2:
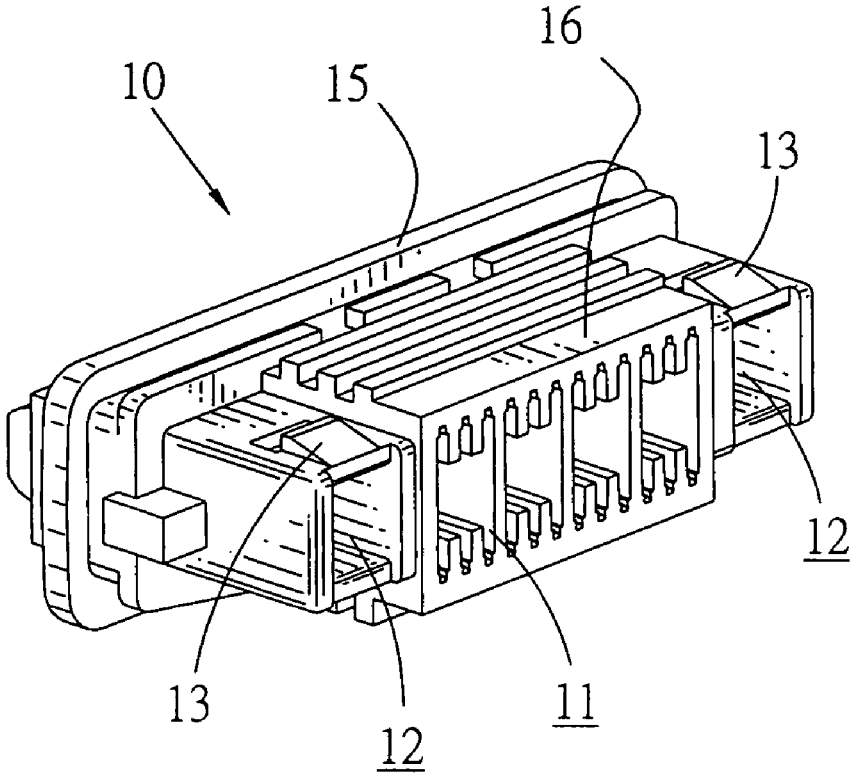
FIG. 2 is a perspective view of a first insulating body of the electrical connector assembly shown in FIG. 1.

With reference to FIG. 2, the first insulating body 10 has a front portion 15 and an opposite rear portion 16. A plurality of first contact grooves 11 crosses through the first insulating body 10. The first insulating body 10 further has two through holes 12 at the two sides of the first contact grooves 11. The two through holes 12 fixes the latching arms 20 therein. The top and bottom surfaces of the rear portion 16 of the first insulating body 10 provide four fixing blocks 13 (two top fixing blocks 13 shown in FIG. 2).

Figure 3:
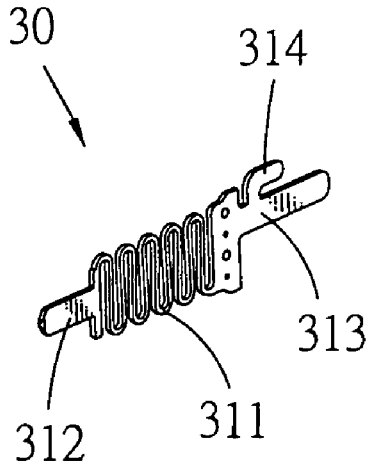
FIG. 3 is a perspective view of a first contact of the electrical connector assembly.

With reference to FIG. 3, each first contact 30 has a positioning-portion 311, a front-touching portion 312 and an opposite rear-touching portion 313. The positioning-portion 311 can be a snake-shape. The front-touching portion 312 and the rear-touching portion 313 can be a strip-shape. Each first contact 30 further has a hook 314 which is formed above the rear-touching portion 313.

Figure 4:
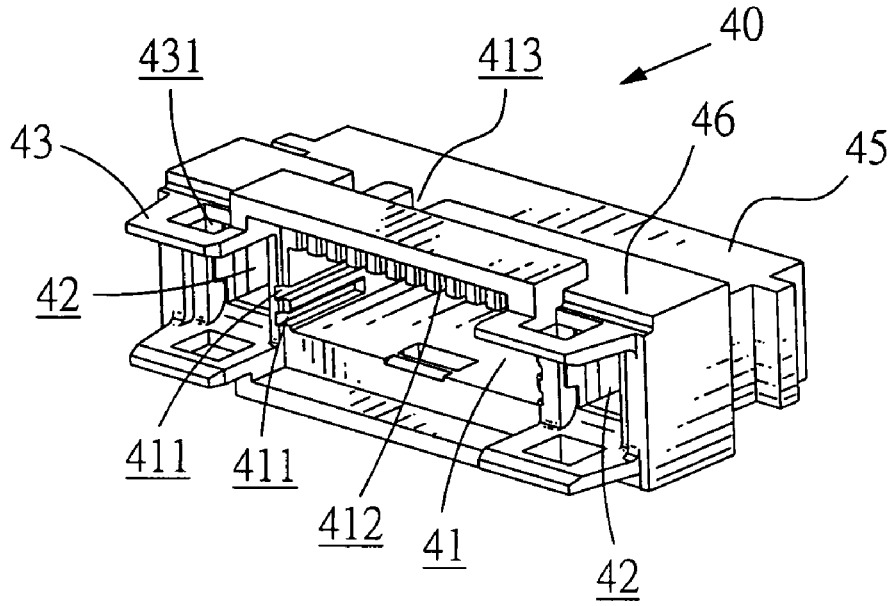
FIG. 4 is a perspective view of a second insulating body of the electrical connector assembly shown.

With reference to FIG. 4, the second insulating body 40 has a front portion 45 and an opposite rear portion 46. There is a receiving cavity 41 crossing through the second insulating body 40. A plurality of fixing grooves 411 are defined in the side walls of the receiving cavity 41. A plurality of hook grooves 412 are defined in the top wall of the rear portion 46. Two notches 413 are defined in the top surface of the second insulating body 40 for communicating two of the hook grooves 412 with outside. The second insulating body 40 further has two passageways 42 respectively defined at the two sides of the receiving cavity 41. The rear portion 46 of the second insulating body 40 extends rearwards to form four flat pieces 43. Each flat piece 43 defines a fixing hole 431 therein.

Figure 5:
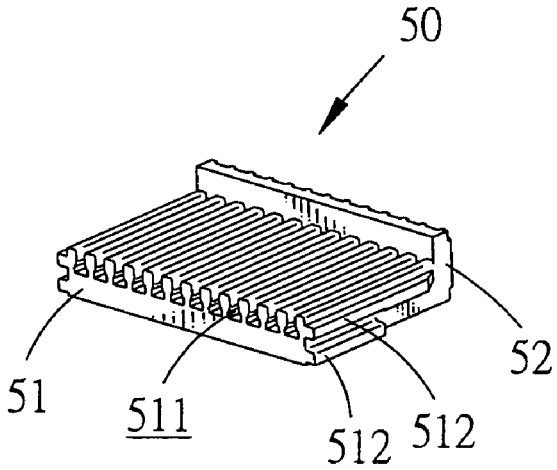
FIG. 5 is a perspective view of a contact base of the electrical connector assembly.

With reference to FIG. 5, the contact base 50 includes a lateral board 51 and an integrated vertical board 52. The lateral board 51 defines a plurality of second contact grooves 511 thereon. The second contact grooves 511 cross through the vertical board 52. The contact base 50 provides a plurality of fixing flanges 512 corresponding to the fixing grooves 411.

Figure 6:
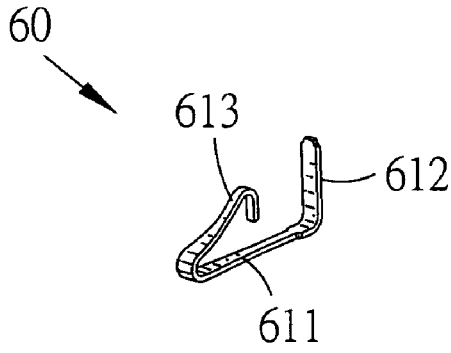
FIG. 6 is a perspective view of a second contact of the electrical connector assembly.

With reference to FIG. 6, each second contact 60 has a positioning-portion 611, a front-touching portion 612 and an opposite rear-touching portion 613. The positioning-portion 611 can be assumes a lateral strip-shape. The front-touching portion 612 can be a vertical strip-shape and the rear-touching portion 613 can be a crook-shape.

Figure 7:
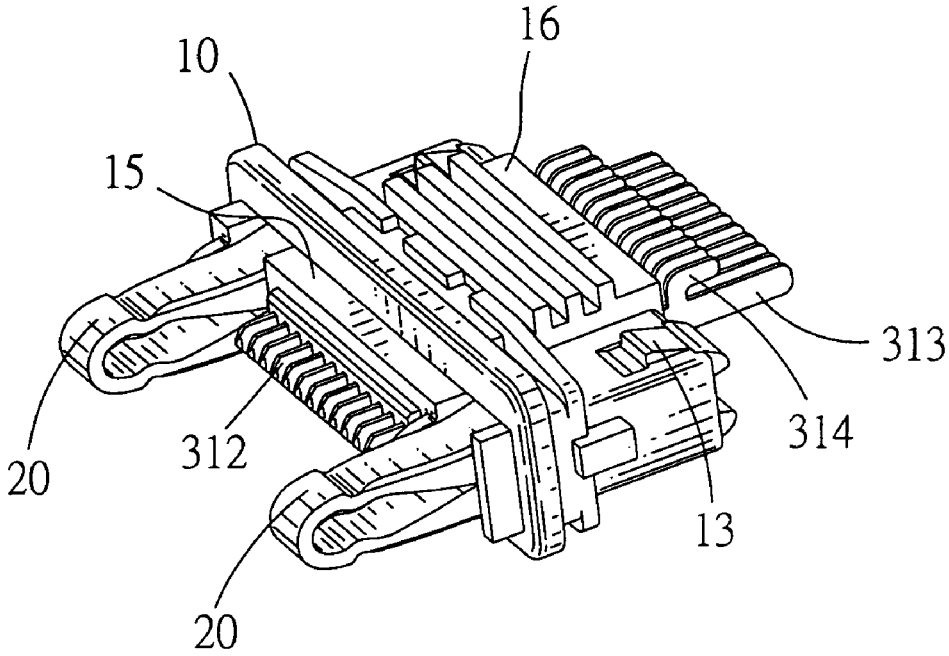
FIG. 7 is a perspective view of the first insulating body with the first contacts assembled therein.
Figure 8:
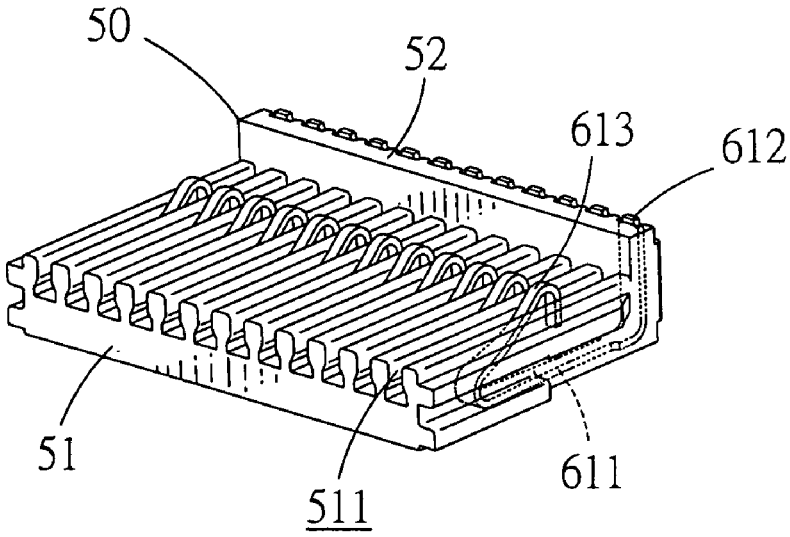
FIG. 8 is a perspective view of the contact base with the second contacts assembled thereon.
Figure 9:
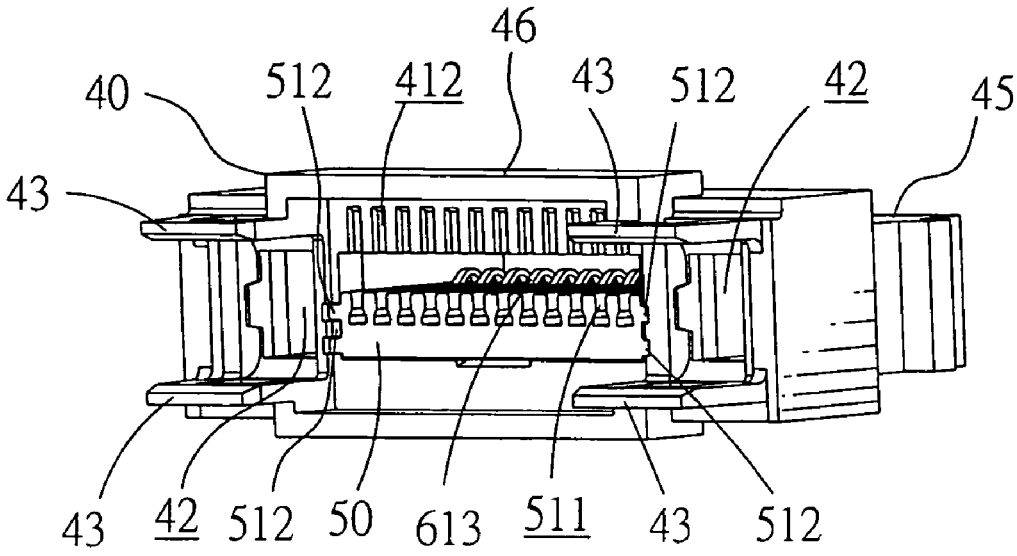
FIG. 9 is a perspective view of the second insulating body with the second contacts and the contact base assembled viewing from rear side.
Figure 10:
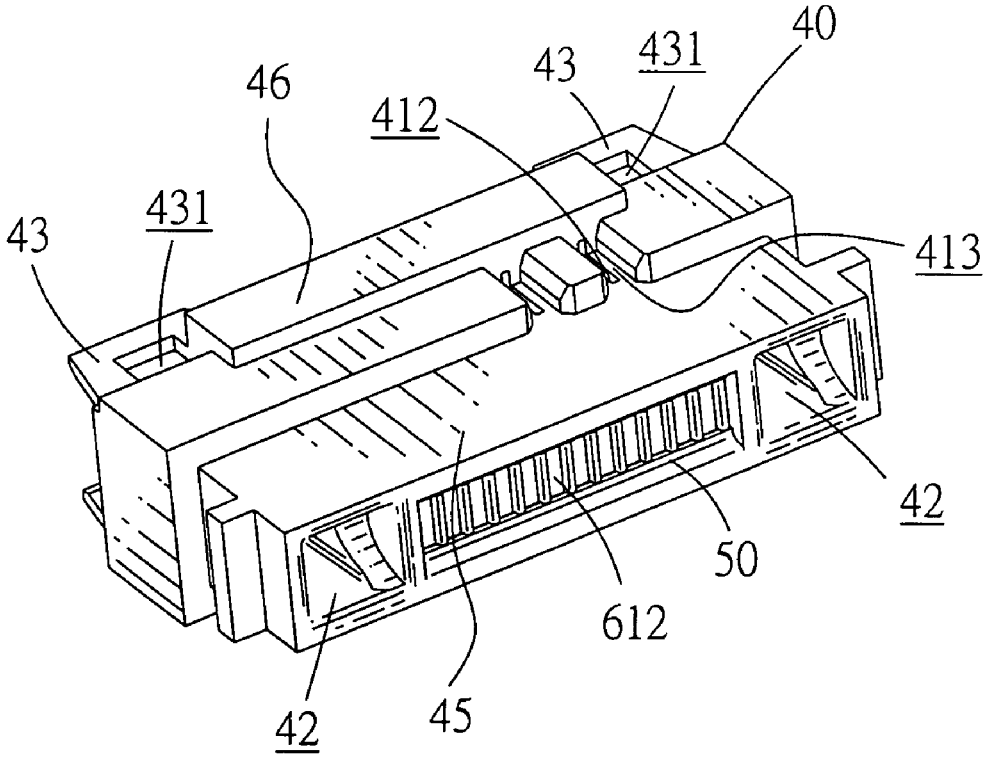
FIG. 10 is another perspective view of the second insulating body with the second contacts and the contact base assembled viewing from another side.
Figure 11:
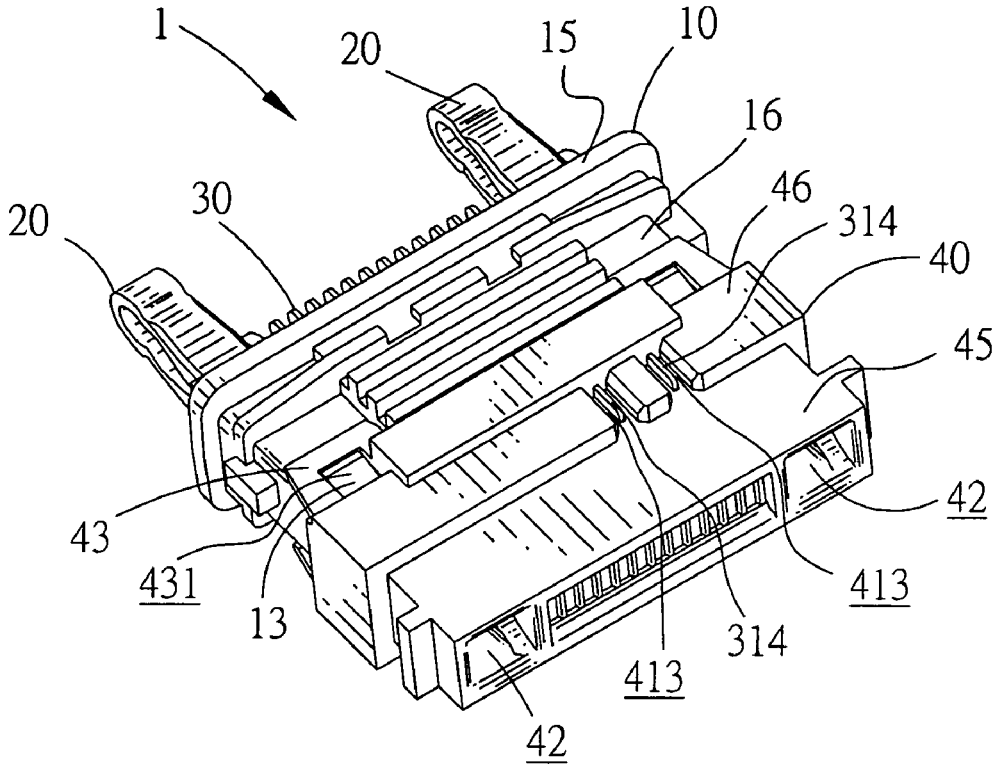
FIG. 11 is a perspective view of the electrical connector assembly according to the present invention.
Figure 12:
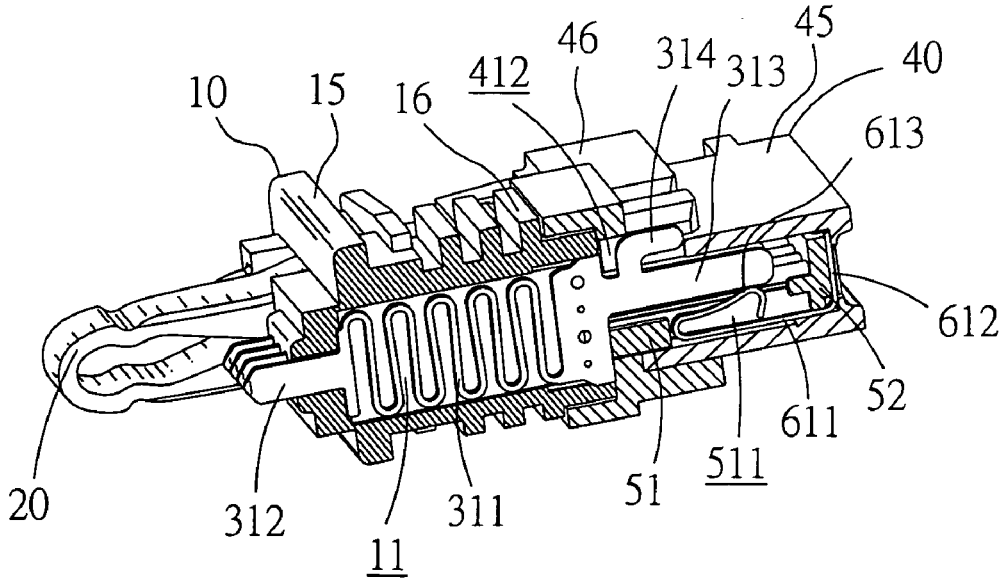
FIG. 12 is a perspective view of the electrical connector assembly with partial portion torn off to show the first contact.

With reference to FIGS. 7-12, for assembling the electrical connector assembly 1, firstly, the first contacts 30 is disposed in the first insulating body 10 with the positioning-portion 311 of each first contact 30 held in the first contact grooves 11 and the front-touching-portion 312 and the rear-touching-portion 313 of each first contact 30 respectively located out of the front-portion 15 and the rear-portion 16 of the first insulating body 10 (shown in FIG. 7). Next, the second contacts 60 is disposed on the contact base 50 with the positioning-portion 611 of the second contact 61 held in the second contact grooves 511 and the front-touching portion 612 attached to the vertical board 52 and the rear-touching portion 613 located above the lateral board 51 (shown in FIG. 8). Then, the contact base 50 with the second contacts 60 disposed thereon is further inserted into the receiving cavity 41, so that the fixing flanges 512 of the contact base 50 are infixed into the fixing grooves 411, the front-touching-portion 612 located at the front-portion 45 and the rear-touching-portion 613 located at the rear-portion 46 (shown in FIG. 9 and FIG. 10). Finally, the electrical connector assembly 1 are integrated together by inserting the rear-touching-portion 313 and the hooks 314 into the receiving cavity 41 and locking the fixing blocks 13 into the fixing holes 431 (shown in FIG. 11). With reference to FIG. 12, the rear-touching portions 313 of the first contacts 30 touch with the rear-touching portions 613 of the second contacts 61 and the hooks 314 of the first contacts 30 are received in the hook grooves 412 when the assembling of the electrical connector assembly 1 is completed.

As mentioned above, there are a plurality of fixing blocks 13 provided on the rear portion 16 of the first insulating body 10 and corresponding fixing holes 431 defined in the rear portion 46 of the second insulating body 40, so the electrical connector assembly 1 according to the present invention has a simplified structure and is convenient for assembling.

However, although a preferred embodiment of the present invention has been described in detail hereinabove, the variations and/or modifications, such as abandoning the contact base 50 and directly disposing the second contacts in the second insulating body by defining the second contact grooves in bottom wall of the receiving cavity 41 directly, will fall within the spirit and scope of the present invention, as defined in the appended claims.

What is claimed is:

1. An electrical connector assembly, comprising:

a first insulating body having a front portion and an opposite rear portion, a plurality of fixing blocks being provided on the rear portion, and a plurality of first contact grooves crossing through the first insulating body, wherein the first insulating body has a plurality of through holes at two sides of the first contact grooves and a plurality of latching arms detachably fixed in the through holes;

a plurality of first contacts removably disposed in the first contact grooves of the first insulating body;

a second insulating body having a front portion and an opposite rear portion, a plurality of fixing holes being defined in the rear-portion of the second insulating body, the fixing blocks of the first insulating body being locked in the fixing holes of the second insulating body, and a receiving cavity crossing through the second insulating body, wherein the second insulating body has a plurality of passageways respectively defined at the two sides of the receiving cavity;

a plurality of second contacts removably disposed in the receiving cavity, the first contacts touching with the second contacts in the receiving cavity of the second insulating body, and a contact base, the contact base being received in the receiving cavity of the second insulating body and defining a plurality of second contact grooves thereon, the second contacts being held in the second contact grooves, the side walls of the receiving cavity of the second insulating body defining a plurality of fixing grooves, the contact base providing a plurality of fixing flanges corresponding to the fixing grooves wherein the fixing flanges detachably fit into the fixing grooves, wherein the first contacts each have a front-touching portion and a rear-touching portion with a mid-portion therebetween, the mid-portion has a plurality of curved sections, and a hook is provided above each rear-touching portion.

2. The electrical connector assembly as claimed in claim 1, wherein the fixing blocks are provided on the top and bottom surfaces of the rear portion of the first insulating body.

3. The electrical connector assembly as claimed in claim 2, wherein the rear portion of the second insulating body extends rearwards to form four flat pieces, the fixing holes being defined in the flat pieces.

4. The electrical connector assembly as claimed in claim 1, wherein a top wall of the rear portion of the second insulating body has a plurality of hook grooves which engage the hooks of the first contacts, the rear-touching portion of the first contacts touch the second contacts, and the front-touching portions of the first contacts extend from the front portion of the first insulating body.

5. The electrical connector assembly as claimed in claim 4, wherein each of the second contacts have a front-touching portion, a rear-touching portion and a positioning-portion therebetween, the positioning-portion being at a right angle to the front-touching touching portion and being at an obtuse angle with the rear-touching portion, the rear-touching portion extending towards the front-touching portion, the rear-touching portion of the second contacts touching the rear-touching portion of the first contacts, and the front-touching portion of the second contacts being exposed at the front portion of the second insulating body.

6. The electrical connector assembly as claimed in claim 5, wherein the rear-touching portions of the first contacts overlay the rear-touching portions of the second contacts.

7. The electrical connector assembly as claimed in claim 6, wherein the latching arms extend from the front portion of the first insulating body beyond the front-touching portions of the first contacts, the first contacts being between the latching arms.

* * * * *